US006809992B1

(12) United States Patent
Ermel et al.

(10) Patent No.: US 6,809,992 B1
(45) Date of Patent: Oct. 26, 2004

(54) ANALOG CLOCK WITH A TWENTY FOUR HOUR DISPLAY

(75) Inventors: John C. Ermel, Burgstrasse 3, CH-4143 Dornach (CH); Robert Greubel, La Neuveville (CH); Stephen Forsey, Le Col-des-Roches (CH)

(73) Assignee: John C. Ermel, Dornach (CH)

( * ) Notice: Subject to any disclaimer, the term of this patent is extended or adjusted under 35 U.S.C. 154(b) by 512 days.

(21) Appl. No.: 09/830,929

(22) PCT Filed: Sep. 1, 2000

(86) PCT No.: PCT/CH00/00466

§ 371 (c)(1),
(2), (4) Date: Aug. 1, 2001

(87) PCT Pub. No.: WO01/18612

PCT Pub. Date: Mar. 15, 2001

(30) Foreign Application Priority Data

Sep. 2, 1999 (CH) ..... 1603/99

(51) Int. Cl.[7] ..... G04B 19/04
(52) U.S. Cl. ..... 368/80; 368/228; 368/76
(58) Field of Search ..... 368/76, 80, 223, 368/228, 238

(56) References Cited

U.S. PATENT DOCUMENTS 5,172,350 A * 12/1992 Walen et al. ..... 368/238
5,696,740 A * 12/1997 Inabinet ..... 368/80

FOREIGN PATENT DOCUMENTS

| | | |
|---|---|---|
| DE | 525062 | 4/1931 |
| DE | 8122028 | 2/1982 |

* cited by examiner

*Primary Examiner*—David Martin
*Assistant Examiner*—Jeanne-Marguerite Goodwin
(74) *Attorney, Agent, or Firm*—Jenkens & Gilchrist, P.C.

(57) ABSTRACT

A clock with a twenty four hour display includes a minute hand, a second hand, a minute scale, a date display, and an hour scale on a first conchoid. The first conchoid includes an outer loop for the hours of the day from 6–18 hours and an inner loop for the hours of the day from 18-6. A crossing point of the inner and outer loops is established at the hours of 6 and 18. To achieve unambiguous indication, the hour hand is made variable in length. In a second conchoid offset by a constant amount radially inwards with respect to the first conchoid, which for instance is milled in the form of a groove in the dial, a guiding element is moved azimuthally through the inner part of the hour hand, which receives an overlay of radial movement owing to the shape of the second conchoid. The second conchoid and the guiding element may be covered by a disc joined to the inner part of the hour hand and turning with it.

12 Claims, 3 Drawing Sheets

ANALOG CLOCK WITH A TWENTY FOUR HOUR DISPLAY

BACKGROUND OF THE INVENTION

1. Technical Field

The present invention concerns a clock, driven by a mechanical, electrical or electronic motor, with analog and unambiguous 24 hour display.

2. Description of the Related Art

Several clocks with an analog and unambiguous 24 hour display are known, for instance from DE 267 810 (D1), U.S. Pat. No. 5,696,740 (D2), WO 91/03774 (D3).

Both in D1 and in D2 the 24 hour unambiguity is obtained by means of two concentric number scales each of 12 hours, where the first 12 hour group comprises the times from 0–12 o'clock, the second the time from 12–24 o'clock. On the transfer from one scale to the other the hour hand always changes its position in an abrupt manner; it either travels outwards or is shortened.

In D3 the unambiguity of the display of the hours is addressed similarly in that two concentric 12-hour scales are arranged on the dial, at the same time however a transparent disc is present which has a period of revolution of 24 hours and—in one embodiment—has two semicircular shaped covers, which cover the nonapplicable hour values.

Further documents though not under consideration here—(i.e. DE 33 05 414 and DE 40 376 57) show clocks with so-called pseudo-analog presentation, where using electronic auxiliary means, such as LEDs and liquid crystal displays, an unambiguous 24-hour display is, created.

The arrangements published in D1 and D2 for the changing of the length of the hour hand require either additional energy from the clock motor for tensioning a spring (D1) or an additional source of energy (D2). The solution proposed in D3 shows the hours at all times of the day and night on two semi circles of different radius. Neither in terms of technical producibility nor in market acceptance were these solutions able to succeed.

Although it would be possible with the means described, the transfer from one scale to the to the other was never chosen to be other than at midday and midnight.

Further, clocks have become known, which have noncircular scales, such as for instance in DE 196 41 885 (D4), DE 299 03 950 (D5) and DE 299 34 451 D6). Whilst in D4 an hour indicating element is moved on any desired curve as a guiding element, in D5 the indicating element is guided on cycloids, which are generated by a four joint drive, by means of an additional gear wheel, means are described here to move the aforesaid indicating element on non-circular tracks, but a 24-hour indicator of an unambiguous nature is not published therein.

BRIEF SUMMARY OF THE INVENTION

It is therefore the aim of the present invention to move the hour marking indicating element—whether this is the hour hand or a clear and unmistakable element—on a track of this construction, which permits an unambiguous arrangement of the positions of the indicating element during the 24-hour passage of the day and so by its position effects a conspicuous difference between the daytime and night-time hours without the need to alter the customary angular positions of the indicator.

BRIEF DESCRIPTION OF THE DRAWINGS

The inventive idea is more closely explained using the attached drawing in several embodiments.

Shown are.

DETAILED DESCRIPTION OF THE PREFERRED EMBODIMENTS

Figure 1:
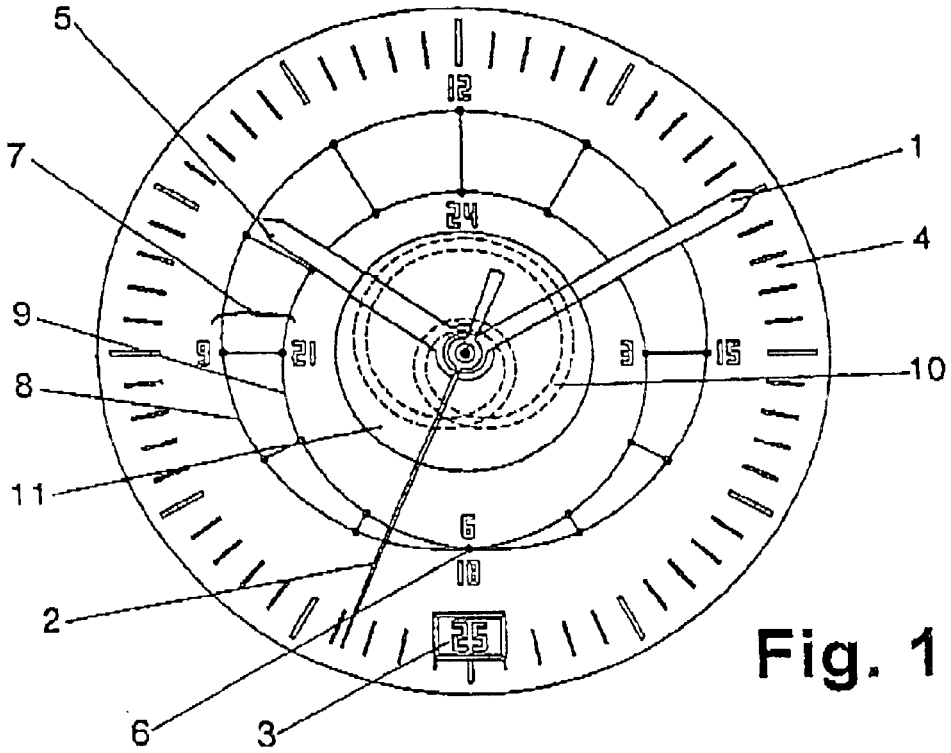
FIG. 1 the plan view of a first embodiment.

FIG. 1 is a plan view of a first embodiment of a clock according to the invention. Along with conventional and here adopted elements, such as a minute hand 1, second hand 2, date display 3 and a conventional circular minute scale 4, an hour hand 5 with variable length is shown. The point of the hour hand 5 runs around a two-loop enclosed curve, such as a first conchoid 7, with an outer loop 8 and an inner loop 9, which have a crossing point 6. The daytime hours from 6 to 18 hours are allocated to the outer loop 8 and the night-time hours from 18 to 6 hours to the inner loop 9. Since these allocations are only of a graphical nature, they can obviously be reversed. On such two-loop curve is for instance the conchoid, also called the Pascal snail curve, (described, for instance, in Karel Rektorys, applicable Mathematics, Cambridge, Mass., USA 1969). FIG. 1 includes the representation of a second conchoid 10, shown dashed, which is derived by a constant radial offset from the curve 7 with an outer loop 8 and an inner loop 9. This second conchoid 10 is shown dashed because it can be covered by a disc 11; it is formed as a guide curve and together with the guiding elements is more clearly explained in FIG. 2.

Figure 2:
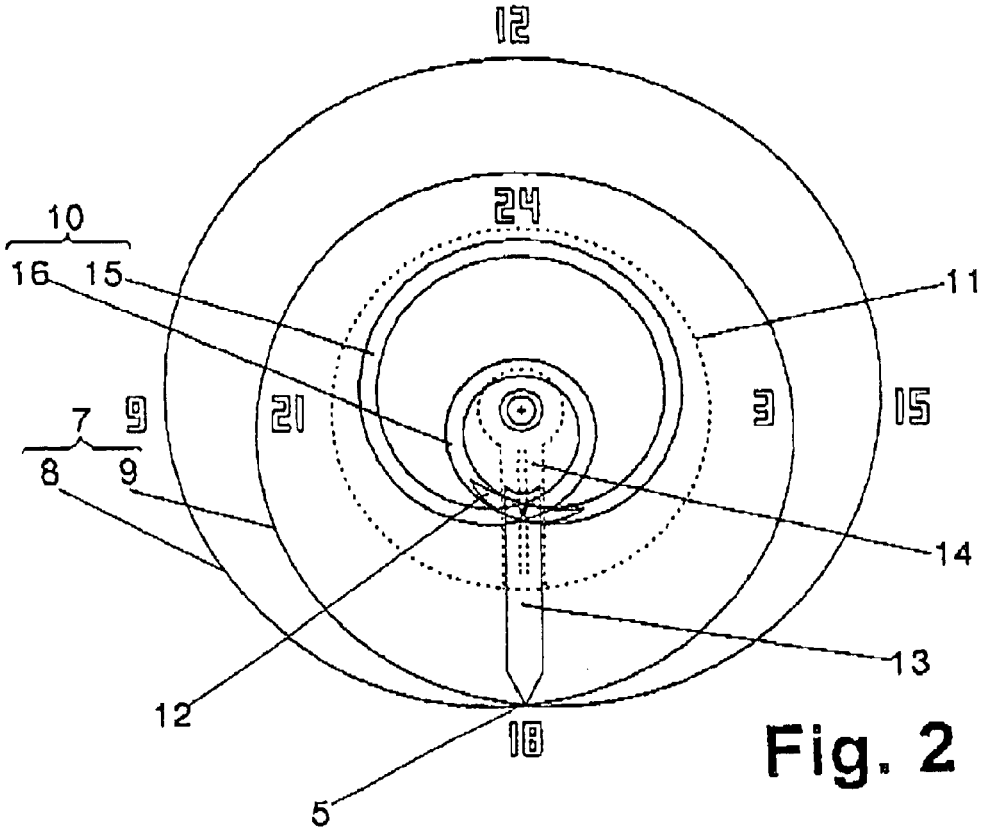
FIG. 2 a part of FIG. 1, with a first embodiment of a guide element.

FIG. 2 is the representation of only the inventive part of the clock. The disc 11 is shown here only dashed and transparent and allows a clear view of the conchoid 10 lying below and covered by the disc 11. The hour hand 5 is, as was already seen in FIG. 1 constructed from two parts. Its outer part, referenced with the reference 13, is joined in a pivoting manner to a sliding element 12; this sliding element 12 lies in the for instance groove shaped conchoid 10 and follows the track of this conchoid during the circulation of the inner part of the hour hand 5. This inner part of the hour hand 5 carries the reference 14, and is joined firmly to the disc 11. The disc 11 thus completes a revolution in 12 hours, together with the inner part 14 of the hour hand 5 The sliding element 12 is formed in this embodiment in a sickle shape such that the radius of curvature of the outer-lying surface is smaller than the smallest radius of curvature of the outer surface of the conchoid 10, and that of the inner lying surface is greater than the greatest radius of curvature of the inner surface of the conchoid 10. The longitudinal extension of the sliding element 12 measured in the tangential direction is made large enough so that at the crossing point of the two loops, of the conchoid 10 (which carry the references 15, 16) the sliding element 12 is guided securely from the outer loop 15 to the inner loop 16, or from the inner loop 16 securely onto the outer loop 15.

Figure 3:
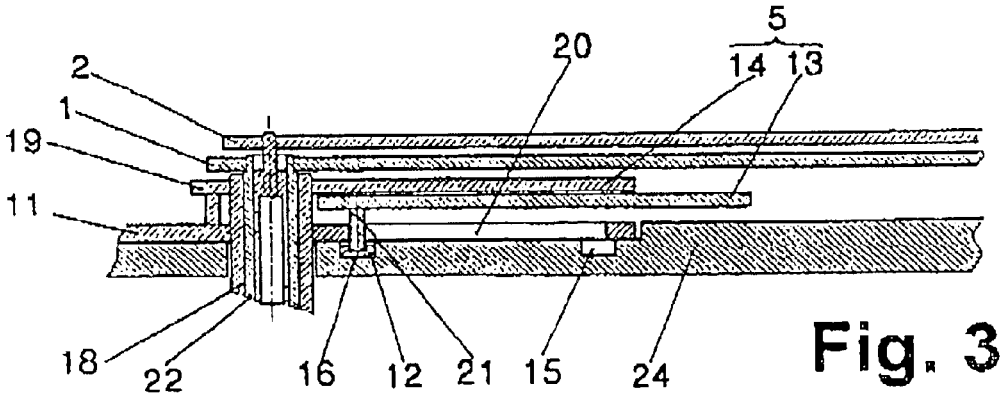
FIG. 3 a longitudinal section through the embodiment in FIG. 1.

FIG. 3 is a longitudinal section through the embodiment of FIG. 1 for instance at 24 hours. A dial 24 serves here in the sense of a non-limited example of a mounting platform for all further named and yet to be named elements. This element named below as dial 24 can be attached either to the works, or the case. It is only essential that in the operation of the clock the relationship to the actual dial is fixed. The conchoid 10 with its outer loop 15 and its inner loop 16 is worked into the dial 24 for instance by milling. A hollow shaft, called the hour tube 18, is mounted within the dial 24, with which the disc 11 and the inner part 14 of the hour hand 5 are joined firmly. For stability reasons the inner part 14 of the hour hand 5 is joined to the disc 11 for instance with a support 19. The disc 11 has a radial slit 20 running parallel to the inner part 14 of the hour hand 5. A guide pin 12, with which the outer part 13 of the hour hand 5 is joined to the sliding element 12, can move in this slit 20. The sliding element 21 is thus moved in an azimuthal direction by the disc 11. The guide pin 21 is for instance firmly fixed to the sliding element 12 and mounted in the outer part 13 of the hour hand 5 so as to pivot about its long axis. In accordance with the invention this can however also be arranged so that the guide pin 21 is firmly fixed to the outer part 13 of the hour hand 5 and mounted on the sliding element 5 so as to pivot about its long axis.

The outer part 13 of the hour hand 5 is arranged so as to be able to slide in the longitudinal direction with respect to its inner part 14, for which arrangement several solutions are known and not to be described here.

The remaining elements, such as the minute tube 22 with the minute hand 1 and the second axle 23 with the second hand 2 are known and only mentioned for completeness. The concept of the dial can be widely interpreted here; the decision as to which and whether figures appear on it is purely of an aesthetic nature. The technical significance of the dial 24 lies in its characteristic as, a baseplate for all the previously mentioned elements in the sense of the previous description.

Figure 4:
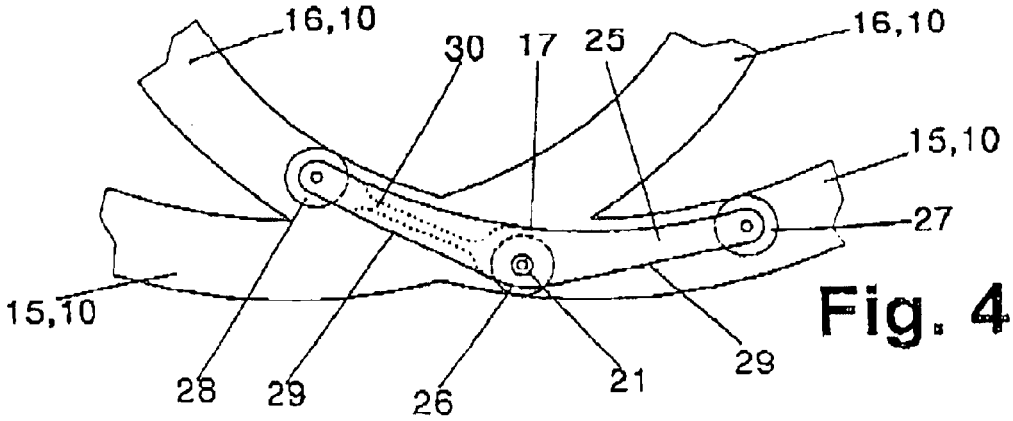
FIG. 4 a detail from FIG. 3 with a second embodiment of a guide element, FIG. 5 a second embodiment in a schematic longitudinal section, FIG. 6 the embodiment in FIG. 5 in a schematic plan view.

A section of the conchoid 10 is shown in FIG. 4, together with a further embodiment of sliding element 12 from FIG. 2, 3 named a-guide element 17. This comprises a carrying member 25 and here for instance three wheels 26, 27, 28 rotatably mounted within it. Their arrangement is selected such that the middle wheel 26 lies outside, so that it can touch the outer surface of the conchoid 10; the other two wheels 27, 28 can touch the inner surface of the conchoid 10. The arrangement of the three wheels 26, 27, 28 is further so designed that the guiding element 17 both in that part of the conchoid 10 with the greatest radius and also that with the smallest it can be moved with radial play in the tangential direction. In the region of the middle wheel 26 the carrying member 25 carries the guide pin 21, for which the same applies as previously stated under FIG. 3.

Also included in FIG. 4, however dotted, is a modification of the carrying member 25. One arm 29 of the carrying member 25 is constructed as a flexing spring 30, so that all three wheels 26, 27, 28 can always touch the side surfaces of the conchoid 10 assigned to them. Alternatively both arms of the carrying member 25 can be constructed as flexing springs 30, whereby the applied pressure of the wheels 26, 27, 28 onto the side surfaces can be better apportioned.

The length of the guiding element 17, that is the separation of the wheels 27, 28 is chosen such that the crossing point of the two loops 15, 16 of the conchoid 10 can be passed in the correct sense. The number of wheels 26, 27, 28 can obviously be chosen to be different, for instance larger, with a corresponding adaptation of the form and construction of the carrying member 25.

Figure 5:
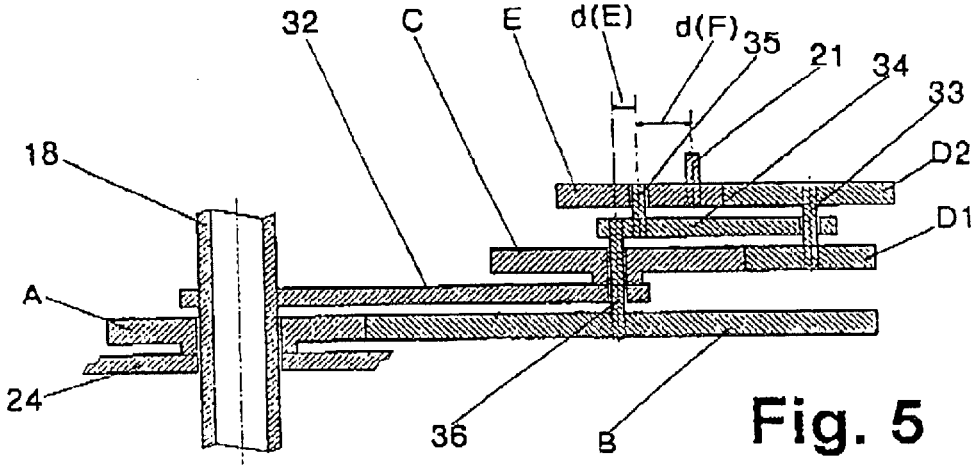
Figure 6:
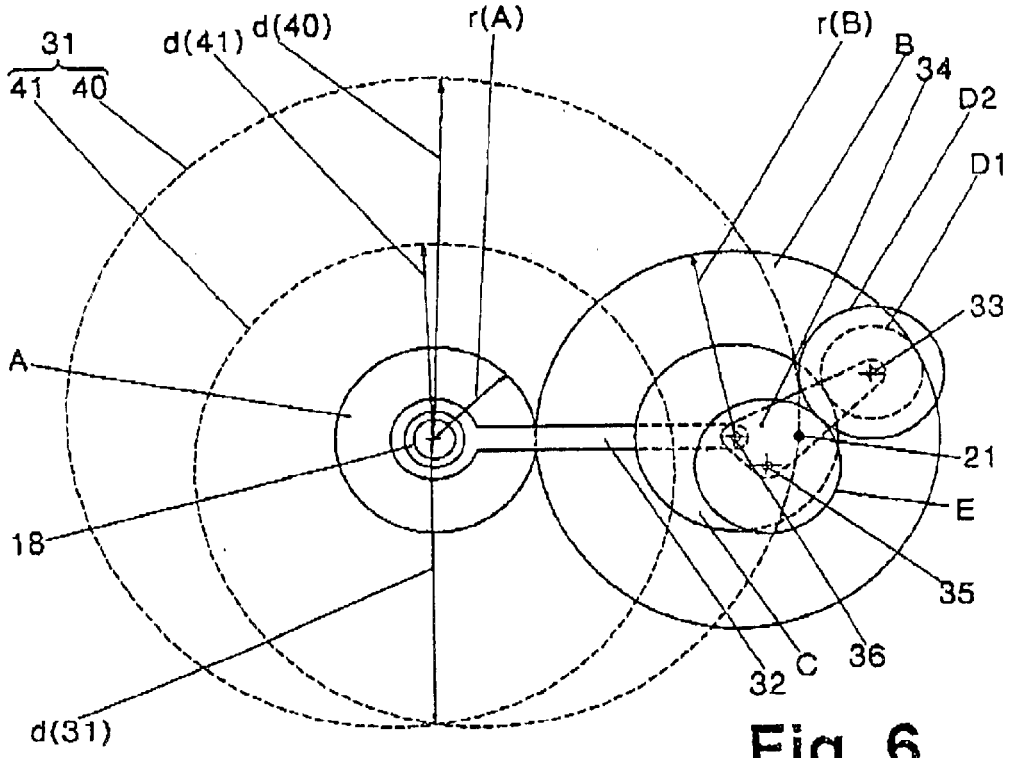

FIGS. 5 and 6 are representations of a second embodiment for the guidance of the point of the hour hand 5 onto the two-loop curve 7 provided. FIG. 5 is a section perpendicular to the plane of the dial 24, FIG. 6 a plan view. For a better understanding, FIG. 5 is produced so that all the sequential axes lie in the same plane, which actually is never; the case.

In FIG. 6 a two-loop curve (also called a Pascal snail) 31 is shown dashed, with an outer loop 40 and an inner loop 41 and a crossing point 42. This corresponds functionally to the conchoid 10 from FIG. 2 and also in so far as it at least indicates the track of the guide pin 21 in so far as that obviously a radial offset: by a constant, or also by a variable amount—for instance proportional—is included within the inventive idea. This curve 31 is generated in this embodiment by the interworking of several gear wheels and guide arms, as set out below: Firmly fixed to the dial 24—or the assembly platform corresponding to it—is a gear wheel A with radius r(A), coaxial with the hour tube 18. The hour tube 18 carries an arm 32, circulating with it, in which an axle 36 of a second gear wheel B with radius r(B) is mounted, whereby:

$$r(B)=2r\ (A) \qquad \text{equation (1)}$$

Further these radii and the crossing point 42 of the two loops 40, 41 of the curve 31—whose distance from the centre of the hour tube is designated d(31)—are connected such that $$r(A)+r(B)=d(\mathbf{31}) \qquad \text{equation (2)}$$

The arm 32 can be a flat-formed component in a plane parallel to that of thee gear wheels. It carries here, firmly fixed to it, a third gear wheel C with radius r(C), which meshes-with a fourthgear wheel D1 with radius r(D1), which is mounted on an axle 33. This is mounted in a second arm 34. The second arm 34 sits firmly on the axle 36 of the second gear wheel B and therefore runs around with this. The axle 33 of the fourth gear wheel D1 carries—similarly joined firmly to it—a fifth gear wheel D2 with radius r(D2) which meshes with a sixth gear wheel E with radius r(E). This sixth gear wheel E is mounted on an axle 35, which is fastened on the second arm 34 at a distance d(E) from the axle 36 and runs parallel to all the previously mentioned axles. The sixth gear wheel E carries at a distance d(F) from the axle 35 the guide pin 21 running parallel to the axles 33, 36.

The following equations apply for the further named radii and distances:

$$r(D\mathbf{1})=\mathbf{1/2}r(C) \qquad \text{equation (3)}$$

$$r(E)=r(D\mathbf{2}) \qquad \text{equation (4)}$$

$$d(E)=d(F) \qquad \text{equation (5)}$$

Whilst the crossing point 42 of the two loops 40, 41 is fixed by equation (2), the two loops 40, 41 themselves are only defined by the equations (3), (4), (5) and (6):

$$d(\mathbf{40})-d(\mathbf{41})=\mathbf{4}d(E) \qquad \text{equation (6)}$$

The choice of r(C) is not dependent on r(A), but purely opportunistically based on the available space, with the limitation that—if the hour tube 18 is given the radius r(18)

$$R(C)<r(A)+r(B-r(\mathbf{18}) \qquad \text{equation (7);}$$

The disc 11 and the outer and inner parts 13, 14 of the hour hand 5 are, not shown in FIG. 5, 6. All these elements can be arranged as shown in the first embodiment.

As a modification to this the actual dial 24 can be made at least partly transparent and arranged such that the minute and second hands 1, 2 run above it, the hour display, however, below it. Instead of the guide pin 21 the gear wheel E then bears an especially prominent marking, owing to its brightness or colour—for instance a round small disc—which runs around the-two-loop curve 31. This small disc then replaces the point of the hour hand 5. The latter and also the aforesaid small disc are then indicating elements.

For the gearing specialist other arrangements of gear wheels and possibly the arms carrying them, can be realised and are included in the inventive idea, which fulfill the aim of generating the desired conchoid as a track for the indicating, element, using a guide pin 21 or a corresponding component.

What is claimed is:

1. A clock, with a mechanical, electrical or electronic motor, with analog and unambiguous 24 hour display, with at least one indicating element for the hours, the clock comprising:

at least one indicating element for the hours being driven by an hour tube and running around a first conchoid;

wherein each point is touched exactly once in 24 hours by the indicating element whereby the first conchoid has an outer loop, and an inner loop with a crossing point of the inner loop and the outer loop; and guiding means for guiding the at least one indicating element along the first conchoid.

2. A clock according to claim 1, wherein the guiding means comprise:

a groove, at least indirectly connected to a dial wherein the groove is formed as a second conchoid;

a guiding element for moving along in the second conchoid, the guiding element carrying a guide pin;

an element fixed to an hour tube, the element moving the guiding element in the second conchoid at least indirectly; and wherein the indicating element is moved in a radial direction by the guide pin, and in the azimuthal direction by the element fixed to the hour tube.

3. A clock according to claim 2, wherein the indicating element comprises:

an inner part, wherein the inner part is joined to the element joined to the hour tube; and an outer part, wherein the outer part is slid in a radial direction relative to the inner part and is moved by the guide pin in an azimuthal direction, wherein the guide pin is at least indirectly in connection with the said outer part.

4. A clock according to claim 3, wherein the guiding element, is a sickle shaped sliding element moving azimuthally with radial play in the second conchoid;

wherein an outer radius of curvature of the sickle shaped sliding element is smaller than a smallest radius of curvature of an outer surface of the second conchoid, and wherein an inner radius of curvature of the sickle shaped sliding element is greater than a greatest radius of curvature of an inner surface of the second conchoid.

5. A clock according to claim 3, wherein:

the guiding element, which carries the guide pin, includes at least three wheels with parallel axles perpendicular to a plane of the dial;

the guiding element includes two arms and a carrying member in which the at least three wheels are mounted;

each of the two arms carries one of the at least three wheels, and a third of the at least three wheels is mounted between a first and second of the at least three wheels in the carrying member;

the at least three wheels are arranged behind one another in the direction of the track of the second conchoid, so that the first and the second wheels touch the inner surface of the second conchoid and the third wheel touches the outer surface of the second conchoid;

the at least three wheels are further arranged so that, at a position in the second conchoid with the greatest radius of curvature and a position in the second conchoid with the smallest radius of curvature, sufficient radial play is available so as to facilitate azimuthal movement of the guiding element; and the guide pin is arranged in a region of the third wheel.

6. A clock according to claim 5, wherein at least one of the two arms between the third wheel and the first and second wheels is produced as a flexing spring working in a radial direction.

7. A clock according to claim 3 wherein:

the element joined to the hour tube is a disc arranged concentrically to the element;

the indicating element includes an inner part and an outer part, wherein the inner part is joined to the disc;

the outer part of the indicating element slides in relation to the inner part in a radial direction;

the radial movement of the outer part of the indicating element is caused by the guide pin, wherein the guide pin is in engagement, at least indirectly, with the outer part;

the indicating element is the point of the outer part; and the disc is designed such that the disc covers components for guidance of the indicating element.

8. A clock according to claim 7, wherein the disc has a radially running slit for the guide pin.

9. A clock according to claim 1, wherein the guiding means comprises a plurality of gear wheels and a plurality of arms to carry the plurality of gear wheels.

10. A clock according to claim 9, wherein the guiding means, comprises:

a first gear wheel (A), with radius r(A), arranged concentrically with the hour tube with radius r(18) and the first gear wheel is connected at least indirectly to the dial;

a first arm connected to the hour tube and extending outwards, wherein a first axle of a second gear wheel with radius r(B) is rotatably mounted to the first arm;

the second gear wheel (B) lies in the same plane as the first gear wheel (A) and meshes with the first gear wheel;

a third gear wheel (C) with radius r(C) arranged concentrically with the second gear wheel (B) and connected to the first arm, wherein a second arm is fastened to the second gear wheel (B) on the same axle;

a fourth gear wheel with radius r(D1) the fourth gear wheel lying in the same plane as the third gear wheel (C) and the third gear wheel meshes with the fourth gear wheel the fourth gear wheel (D1) is fastened on a second axle running parallel to the first axle, wherein the fourth gear wheel is mounted rotatably in the second arm;

the second arm carries a third axle at a distance d(E) from the first axle, wherein the second arm is fastened to the third axle and the third axle runs parallel to the first axle;

a fifth gear wheel (E) rotatable about the third axle and at a distance d(F) from the third axle the guide pin is arranged parallel to the third axle;

a sixth gear wheel (D2) with radius r(D2) arranged in the same plane as the fifth gear wheel (E) and the fifth gear wheel meshes with the sixth gear wheel, wherein the sixth gear wheel (D2) is fastened on the second axle and the sixth gear wheel is coaxial with fourth gear wheel; and the following relationships apply for the radii r(A), r(B), r(c), r(D1), r(D2):

$$r(B)=2r(A)$$

$$r(C)=2r(D1)$$

$$r(E)=r(D2).$$

11. A clock according to claim 10, wherein:

the crossing point has a distance d(31) from a center of the hour tube wherein $$r(A)+r(B=d(31)$$

applies;

a greatest radial distance of each of the inner loop and outer loop amounts to d(40) or d(41) and is connected to the distances d(E) and d(F) in accordance with the following equations:

$$d(E)=d(F)$$

$$d(40)-d(41)=4d(E);$$

and the hour tube has an outer radius r(18), which together with r(A), r(B), and r(C) define the limitation that:

$$r(C)<r(A)+r(B)-r(18).$$

12. A clock according to claim 11, wherein:

the indicating element at the position of the guide pin is a marking applied to the gear wheel; and the second conchoid is a large as the first conchoid.

* * * * *

UNITED STATES PATENT AND TRADEMARK OFFICE

CERTIFICATE OF CORRECTION

PATENT NO. : 6,809,992 B1
APPLICATION NO. : 09/830929
DATED : October 26, 2004
INVENTOR(S) : John C. Ermel et al.

It is certified that error appears in the above-identified patent and that said Letters Patent is hereby corrected as shown below:

| | |
|---|---|
| Column 5, line 28,<br>Claim 2 | Replace “comprise:”<br>With --comprises:-- |
| Column 8, line 19,<br>Claim 12 | Replace “a”<br>With --as-- |

Signed and Sealed this

Twenty-first Day of November, 2006

JON W. DUDAS
*Director of the United States Patent and Trademark Office*